US006053993A

United States Patent [19]

Reichman et al.

[11] Patent Number: 6,053,993

[45] Date of Patent: Apr. 25, 2000

[54] TITANIUM-ALUMINUM-VANADIUM ALLOYS AND PRODUCTS MADE USING SUCH ALLOYS

[75] Inventors: Steven H. Reichman, Portland; John E. Kosin, Albany; James F. Meyerink, Salem, all of Oreg.

[73] Assignee: Oregon Metallurgical Corporation, Albany, Oreg.

[21] Appl. No.: 09/062,450

[22] Filed: Apr. 17, 1998

Related U.S. Application Data

[62] Division of application No. 08/607,890, Feb. 27, 1996, Pat. No. 5,861,070.

[51] Int. Cl.[7] ..... C22C 14/00

[52] U.S. Cl. ..... 148/421; 420/420

[58] Field of Search ..... 148/421; 420/420, 420/421

[56] References Cited

U.S. PATENT DOCUMENTS

| | | | |
|---|---|---|---|
| 4,898,624 | 2/1990 | Chakrabarti et al. . | |
| 4,943,412 | 7/1990 | Bania et al. | 420/420 |
| 5,032,189 | 7/1991 | Eylon et al. . | |
| 5,156,807 | 10/1992 | Nagata et al. | 420/418 |
| 5,332,545 | 7/1994 | Love | 148/670 |
| 5,360,677 | 11/1994 | Fukai et al. | 420/421 |
| 5,435,226 | 7/1995 | McQuilkin | 89/36.02 |

FOREIGN PATENT DOCUMENTS 5-311367 11/1993 Japan .

*Primary Examiner*—John Sheehan

*Attorney, Agent, or Firm*—Klarquist Sparkman Campbell Leigh & Whinston, LLP

[57] ABSTRACT

A method for forming titanium alloys is described comprising first forming an ingot that includes: (a) from about 5.5 to about 6.75 weight percent aluminum (preferably from about 5.75 to about 6.5 weight percent aluminum), (b) from about 3.5 to about 4.5 weight percent vanadium (preferably from about 3.75 to about 4.25 weight percent vanadium), (c) from about 0.2 to about 0.8 weight percent iron, (d) from about 0.02 to about 0.2 weight percent chromium, (e) from about 0.04 to 0.2 weight percent nickel, (f) from is about 0.004 to about 0.1 weight percent cobalt, (g) from about 0.006 to 0.1 weight percent niobium, (h) from about 0 to about 0.20 weight percent carbon, (i) from about 0.22 to about 0.32 weight percent oxygen, (j) from about 0 to about 0.1 weight percent nitrogen, the balance being titanium and unavoidable impurities, each impurity totalling no more than about 0.2 weight percent, with the combined weight of the impurities totalling no more than about 0.5 weight percent. The ingot is then processed to provide an α-β alloy. A method for forming armor plates also is described. The method comprises forming an alloy according to the general methods described. The alloy is then fashioned into armor plates.

11 Claims, 1 Drawing Sheet

Micrograph of example 1 , 4.1" thick plate

Micrograph of example 1 , 4.1" thick plate

TITANIUM-ALUMINUM-VANADIUM ALLOYS AND PRODUCTS MADE USING SUCH ALLOYS

This is a division of application Ser. No. 08/607,890, filed Feb. 27, 1996, now U.S. Pat. No. 5,861,070.

FIELD OF THE INVENTION

This invention concerns titanium alloys, methods for their manufacture, and products made using the alloys.

BACKGROUND OF THE INVENTION

Titanium is an inert, metallic element having a high strength-to-weight ratio. Titanium has a relatively high melting point (1668±5° C.), which makes it particularly useful for high-temperature applications where other alloys, such as aluminum and magnesium alloys, fail. Titanium also has been used to produce high-strength alloys. These alloys are particularly useful for forming structural devices and ballistic armor.

These and other applications continually demand the development of new alloys. This generally is accomplished by modifying the composition of existing alloys, changing known processing regimens, or developing entirely new alloys and methods for their manufacture. However, it is difficult to predict how best to produce new alloys having desired properties. Small amounts of alloying materials and/or impurities can significantly alter the physical characteristics of the alloy, as can changing how the alloy is processed. For example, minor amounts of impurities can significantly increase the brittleness of the alloy. Kirk-Othmer's *Concise Encyclopedia of Chemical Technology,* pages 1182–1184 (John Wiley & Sons, 1985).

Titanium alloys, processes for their manufacture and devices made from titanium alloys also have been patented. U.S. Pat. No. 5,332,545, entitled *Method of Making Low Cost Ti-6Al-4V Ballistic Alloy,* describes a process for providing equivalent or superior ballistic resistance performance compared to standard Ti-6Al-4V alloys. The process requires increasing the oxygen content to be greater than the conventional limit of 0.20% maximum. The oxygen-rich alloy is then heated at temperatures within the β-phase field, which is referred to as β processing. The '545 patent teaches avoiding α-β processing because it allegedly causes cracks in the alloy, and because it generally is more expensive than β processing.

U.S. Pat. No. 5,435,226, entitled *Light Armor Improvement,* describes a structural armor assembly. The assembly includes a superplastically formed sandwich arrangement that includes a high-toughness, high-strength titanium alloy material. The titanium alloy includes 4.5 weight percent aluminum, 5 weight percent molybdenum and 1.5 weight percent chromium.

Chakrabarti et al.'s U.S. Pat. No. 4,898,624 concerns Ti-6Al-4V alloys which are processed to obtain desired microstructures. Chakrabarti's alloy has 5.5–6.75% aluminum, 3.5–4.2% vanadium, 0.15–0.20 weight percent oxygen, 0.025–0.05% nitrogen and 0.30% iron. The processing steps comprise preheating the composition above the β transus temperature, followed by rapid cooling.

Eylon et al.'s U.S. Pat. No. 5,032,189 concerns α-β alloys. A primary object of Eylon is to provide a new method for forging known near-α and α+β titanium alloys. The alloy processing steps comprise forging an alloy billet (a billet is a bar or ingot of a metal or metal alloy in an intermediate processing stage) to a desired shape at a temperature approximately equal to the β-transus temperature of the alloy, cooling the component, annealing the component at a temperature about 10 to 20% below the β-transus temperature, and cooling the component in air.

Despite the titanium alloys previously developed, there still is a need for additional alloys, particularly for specialized applications such as ballistic armor.

SUMMARY OF THE INVENTION

The method used to form the titanium alloys of the present invention comprises first forming an ingot that includes (a) from about 5.5 to about 6.75 weight percent aluminum (preferably from about 5.75 to about 6.5 weight percent aluminum), (b) from about 3.5 to about 4.5 weight percent vanadium (preferably from about 3.75 to about 4.25 weight percent vanadium), (c) from about 0.2 to about 0.8 weight percent iron, (d) from about 0.02 to about 0.2 weight percent chromium, (e) from about 0.04 to 0.2 weight percent nickel, (f) from about 0.004 to about 0.1 weight percent cobalt, (g) from about 0.006 to 0.1 weight percent niobium, (h) from about 0.02 to about 0.20 weight percent carbon, (i) from about 0.22 to about 0.32 weight percent oxygen, (j) from about 0.009 to about 0.1 weight percent nitrogen, the balance being titanium. Other metallic contaminants and unavoidable impurities also may be present in the composition, with the amount of each being less than about 0.2 weight percent, and the total amount of such contaminants and unavoidable impurities totaling less than about 0.5 weight percent. For instance, the alloy generally also includes 0.03 to about 0.15 weight percent tin, and from about 0.03 to about 0.04 weight percent silicon. Ingots containing these elements in the stated weight percents are then forged to form slabs or billets comprising an α-β alloy.

The α-β alloy processing steps include first heating the ingot to a temperature greater than the β transus temperature ($T_\beta$), which typically involves heating the ingot to a temperature of from about 1900° F. to about 2300° F. A currently preferred temperature for this first heating step is about 2100° F. Although the period of time for this heating step may vary, it currently is believed that the heating should continue for a period of at least about 12 hours. Following this initial heating step, the ingot is forged to intermediate slabs or billets, then cooled to a temperature below $T_\beta$. The slabs or billets are then reheated to a temperature of from about 50° F. to about 250° F. below $T_\beta$ [$T_\beta$—(about 50 to about 250° F.) ], such as from about 1600° F. to about 1850° F. The method may further comprise forging or hot rolling the alloy. The alloy is then annealed at a temperature of from about 1300° F. to about 1450° F., with a currently preferred annealing temperature being about 1350° F.

The method can include several additional, but generally not necessary, steps. These additional steps may include conditioning the surface of the alloy. Examples of such surface conditioning procedures include, without limitation, grinding, shotblasting and/or pickling (a surface treatment comprising bathing a metal in an acid or chemical solution to remove oxides and scale from the metal surface).

A currently preferred method for forming titanium alloys of the present invention comprises forming an ingot that consists essentially of (a) from about 5.75 to about 6.5 weight percent aluminum, (b) from about 3.75 to about 4.25 weight percent vanadium, (c) from about 0.2 to about 0.8 weight percent iron, (d) from about 0.03 to about 0.1 weight percent chromium, (e) from about 0.06 to 0.1 weight percent nickel, (f) from about 0.004 to about 0.01 weight percent cobalt, (g) from about 0.006 to 0.02 weight percent niobium, (h) from about 0 to about 0.05 weight percent carbon, (i) from about 0.24 to about 0.28 weight percent oxygen, (j) from about 0 to about 0.03 weight percent nitrogen, the balance being titanium and unavoidable impurities which total less than about 0.5 weight percent. The ingot is then heated to about 2100° F. for a period of about 12 hours or more. The ingot is forged to an intermediate slab, then air cooled to a temperature below $T_\beta$. Thereafter, if necessary, the slab is again heated, this time to a temperature of from about 1900° F. to about 2000° F., followed by another cooling step.

The slab is then heated to a temperature of from about 50 to about 250° F. below $T_\beta$, such as to a temperature of about 1800° F. The slab is then forged to thinner slabs for hot rolling or final products. Depending upon the final gage of the product produced from the alloy, the slabs are heated to a temperature of from about 50 to about 250° F. blow $T_\beta$, such as to a temperature of about 1800° F., then hot rolled, either longitudinally or cross rolled. Once the slab has been rolled, it is then annealed at a temperature of about 1350° F. to provide an annealed plate. The surface of the annealed plate is then treated, such as by grinding, shot blasting and/or pickling.

A method for forming armor plating also is described. The method comprises forming an alloy according to the general methods described above. The alloy is then fashioned into plates suitable for use as armor plating. It should also be understood that the alloys of the present invention can be used to make other products. For example, the alloys of the present invention could be used to form cast products.

DETAILED DESCRIPTION OF THE PREFERRED EMBODIMENTS

Figure 1:
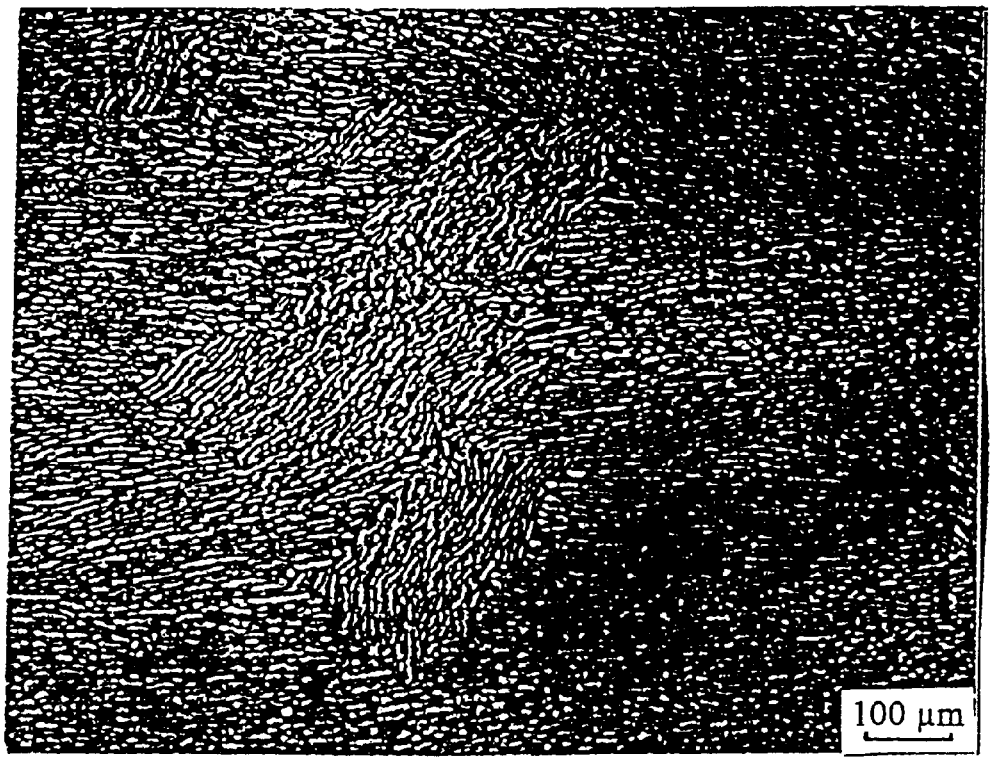
FIG. 1 is a photomicrograph showing the α-β grain structure of a plate made using the alloys of the present invention.

The present invention provides titanium alloys primarily containing titanium, but also comprising aluminum, vanadium, iron, oxygen, carbon, nitrogen, nickel, cobalt, chromium, niobium, and perhaps small quantities of other elements and impurities, such as tin (generally from about 0.03 to about 0.15 weight percent) and silicon (generally from about 0.03 to about 0.04 weight). The constituent elements are combined and then melted to form a unique alloy particularly useful as armor plating. The following paragraphs describe the weight percents of each element used to form the alloys, as well as how the alloy is α-β processed to provide the desired physical and mechanical characteristics.

I. DEFINITION OF TERMS

The following definitions are provided for convenience and should not be construed to narrow any definitions accepted by those of ordinary skill in the art.

α alloys are single phase alloys in which the room temperature stable phase comprises a hexagonal close packed structure. *Metallurgy Theory and Practice,* American Technical Society, Chicago (6th addition, 1977), which is incorporated herein by reference.

β alloys have a room temperature stable phase comprising a body centered cubic structure. Id.

α-β alloys have a two-phase system of body centered and close-packed hexagonal crystal structures. Id.

β transus temperature ($T_\beta$) is the temperature at which the microstructure of the alloy converts from an α alloy to an α+β alloy. α+β alloys are formed upon cooling β alloys to temperatures below the β transus temperature. Id.

II. ALLOY COMPOSITIONS

The present alloys include the elements listed below, plus certain residuals. Residual are elements present in a metal or an alloy in small quantities inherent to the manufacturing process, but which elements are not added to the alloy intentionally.

A. Aluminium

Aluminum is used to form the present alloys in weight percents of from about 5.5 weight percent to about 6.75 weight percent. Preferably, aluminum is used in weight percent of from about 5.75 to about 6.5 weight percent. Best results currently appear to be obtained with alloys comprising from about 6.0 to about 6.4 weight percent aluminum.

B. Vanadium

Vanadium is used in weight percents of from about 3.5 weight percent to about 4.5 weight percent. Preferably, vanadium is used in weight percents of from about 3.75 to about 4.25 weight percent. Best results currently appear to be obtained with alloys comprising from about 3.8 weight percent to about 4.0 weight percent vanadium.

C. Iron

The present alloys include iron in maximum weight percents of about 0.8. Typically, the iron weight percent ranges from about 0.2 to about 0.8. Best results currently appear to be obtained with alloys that include from about 0.20 to about 0.50 weight percent iron.

D. Chromium

Chromium is used to form the present alloys in amounts of from about 0.02 to about 0.2 weight percent. Best results currently appear to be obtained with alloys comprising from about 0.03 to about 0.1 weight percent chromium.

E. Nickel

Nickel is used in weight percents of from about 0.04 to about 0.2 weight percent. Preferably, nickel is used in amounts of from about 0.06 to about 0.1 weight percent. Best results currently appear to be achieved with alloys comprising about 0.075 weight percent nickel.

F. Cobalt

Cobalt is used in amounts of from about 0.004 to about 0.1 weight percent. Preferably, the weight percent of cobalt is from about 0.004 to about 0.01. The best results currently are believed to be achieved by alloys comprising about 0.0049 weight percent cobalt.

G. Niobium

The present alloys include niobium in amounts of from about 0.006 to about 0.1 weight percent. Preferably, the weight percent of niobium is from about 0.006 to about 0.02, with the best results currently believed to be achieved by alloys comprising about 0.0088 weight percent niobium.

H. Carbon

The present alloys include carbon in maximum amounts of about 0.2 weight percent, with a preferred maximum amount being about 0.05 weight percent. Typical carbon weight percents range from about 0.02 to about 0.04. Preferably, the weight percent of carbon is from about 0.025 to about 0.0375, with the best results currently believed to be achieved by alloys comprising from about 0.027 to about 0.029 weight percent carbon.

I. Oxygen

Oxygen is present in the alloys of the present invention in weight percents of from about 0.22 to about 0.32 weight percent. Preferably, the weight percent of oxygen is from about 0.24 to about 0.28 weight percent, with the best results currently believed to be achieved by alloys comprising from about 0.265 to about 0.275 weight percent oxygen.

J. Nitrogen

The present alloys include nitrogen in maximum amounts of about 0.1 weight percent, with a preferred maximum amount being about 0.03 weight percent. Typical nitrogen weight percents range from about 0.009 to about 0.012 weight percent. Best results currently appear to be obtained with alloys comprising about 0.01 weight percent nitrogen.

The elements that are used to form alloys of the present invention, and their weight percents, are summarized below in Table 1. The chemical composition of the alloys was determined according to an analytical method that is substantially equivalent to ASTM-E120.

TABLE 1

| Element | Composition, wt % | Element | Composition, wt % |
|---|---|---|---|
| Aluminum | 5.5 to 6.75 | Carbon | 0.2 max. |
| Vanadium | 3.5 to 4.5 | Oxygen | 0.22 to 0.32 |
| Iron | 0.2 to 0.8 | Nitrogen | 0.1 max. |
| Chromium | 0.02 to 0.2 | Residuals, each max. | 0.2 |
| Nickel | 0.04 to 0.2 | Residuals, total max. | 0.5 |
| Cobalt | 0.004 to 0.1 | Titanium | Remainder |
| Niobium | 0.006 to 0.1 | | |

III. PROCESSING THE TITANIUM ALLOYS

The elements discussed above are combined to form an ingot, which is then processed to form α-β titanium alloys. The method steps used to process the alloys therefore are referred to herein as α-β processing steps, or just processing steps. In general, the α-β processing steps include forging, hot rolling and annealing plates or billets to provide final products. The processing steps may vary slightly from those described herein, particularly depending upon the article that is made from the alloy. The following paragraphs describe steps particularly useful for forming armor plates. It should be understood that the alloys also can be used for other applications, such as for forming cast metal products.

The first processing step is a homogenizing step. An ingot is heated to a temperature greater than the β transus temperature of the alloy. The β transus temperature is from about 1850° F. to about 1930° F. This first heating step typically comprises heating the ingot to a temperature of from about 1900° F. to about 2300° F., with a currently preferred temperature being about 2100° F. The ingot is heated to this temperature for a sufficient time to homogenize the ingot. This typically means that the ingot is heated for about 12 hours, or more.

The homogenizing step is followed by a β forging step to form a forged slab. "Forging" is a hot working process in which metals or metal alloys are made to flow under high compressive forces. The forged slab is generally, but not necessarily, air cooled to a temperature that may be as low as about room temperature, although cooling to room temperature is not required.

Depending upon the size of the final product, the cooling step may be followed by a second heating step. If this second heating step is conducted, the forged slab is again heated to a temperature above the β transus temperature, such as to a temperature of about 1900° F. or higher. This second heating step, while not necessary, generally allows for forging the slab and for further refining the β structure. When this second heating step is used, it generally is continued for a period of about 30 minutes or more.

The slabs are then heated again, this time to a temperature below the β-transus temperature by from about 50° F. to about 250° F. [i.e., $T_\beta$—(50° F. to about 250° F.)]. This heating step to a temperature below $T_\beta$ typically means heating the slab to a temperature of from about 1600° F. to about 1850° F. The slab is then α-β forged to form slabs having thinner thicknesses. This forging step breaks β grains and creates an alloy that includes both α and β grain structures. See FIG. 1, which shows the grain structures of α-β alloys made according to the present invention. Without limitation, a currently preferred temperature for this heating is about 1800° F.

The alloys generally are subjected to a second heating to temperatures of about 50° F. to about 250° F. below the β transus temperature. The alloy is then rolled, such as longitudinally and/or cross rolling. The reheating time typically is at a rate of at least about 20 min/in. The cross rolling and longitudinal rolling can be separate steps, or can be accomplished simultaneously.

The alloy is annealed once the rolling (also referred to as working) step is completed. Annealing is a process for toughening the alloy comprising heating the metal or alloy to an elevated temperature, followed by air or slow cooling. Currently, the annealing temperature is believed to range from about 1300° F. to about 1450° F. (about 22% to about 30% below the β transus temperature), with a currently preferred annealing temperature being about 1350° F.

Processing steps other than those discussed above also can be practiced to produce alloys having desired properties. For instance, surface treatment steps also may be practiced, which generally are used to provide clean surfaces. Such steps generally involve, without limitation, grinding, shot blasting and pickling.

A currently preferred method for processing the alloys of the present invention will now be described. It should be emphasized that the following description is a preferred method for processing alloys for forming ballistic alloys, such as might be used to make armor plates. The invention should not be limited to these precise steps.

Alloys having the compositions discussed above are first heated to a temperature of about 2100° F. for about 12 hours to homogenize the ingot. This first heating step is followed by forging-the ingot to slabs of smaller size to break the cast structure and refine the β structure. The slabs are then cooled.

Following the cooling step, the forged slabs are then heated a second time to a temperature of about 1900° F. and forged. The purpose of this second forging step is to further refine the β structure and forge the slab to a smaller size. This second heating step generally is continued for a period of at least about 30 minutes. The alloy is then cooled, and then subjected to a conditioning step, if necessary.

Following the conditioning step, the alloy is reheated to a temperature of from about 50° F. to about 250° F. below the β transus temperature. Currently, the preferred temperature for this heating step is about 1800° F. The alloy is then forged to a smaller size, cooled, and then subjected to a conditioning step (whereby 100% of the surface of the ingot is ground), if necessary. The alloy is then heated to a temperature of about 50° F. to about 250° F. below the β transformation temperature. Currently, the preferred temperature for this heating step also is about 1800° F. This heating step is a precursor step for working, i.e., rolling, the alloy. Once the alloy is heated to a temperature sufficient to allow working at a rate of about 20 minutes/inch, the alloy is then cross rolled. The alloy also is rolled longitudinally. The cross rolling and longitudinal rolling can be separate steps or combined steps.

Following the working steps, the alloy is then annealed. The preferred annealing temperature currently is believed to be about 1350° F., and the alloy is heated at a rate of about 20 minutes/inch. Following the annealing step, the surface of the alloy is cleaned, such as by shot blasting, and the alloy is then sawcut to the desired dimensions.

A number of plates have been formed according to the general procedures discussed above, as described in the following examples. These examples are to be considered as a guide only, and should not be construed to limit the present invention to the specific features described.

EXAMPLE 1

An armor plate was formed from an alloy having the elements discussed in section 1. The alloy included the elements in the following weight percents: aluminum=6.25 weight percent; vanadium=3.87 weight percent; iron=0.245 weight percent; chromium=0.042 weight percent; nickel=0.078 weight percent; tin=0.03 weight percent; silicon=0.4 weight percent; cobalt=0.0049 weight percent; niobium=0.0088 weight percent; carbon=0.027 weight percent; oxygen=0.265 weight percent; and nitrogen=0.011 weight percent. A 30-inch ingot was made from the mixture, and this ingot was heated to a temperature of 2100° F. for 12 hours. The 30-inch ingot was forged into a slab 18 inches thick. The forged slab was heated for 30 minutes at a temperature of about 1900° F., and then forged a second time to be 14 inches thick. The surface of the slab was subjected to a conditioning step.

Following the conditioning step, the ingot was heated to 1800° F. for 4 hours and 40 minutes. The slab was again forged to produce a slab 11 inches thick. The slab was heated again to a temperature of about 1800° F. for a period of about 55 minutes, and the slab was then forged to be 9.5 inches thick. This forged slab was then cooled to room temperature and conditioned.

A processing furnace was heated to about 1800° F. The slab was then cross rolled, followed by a heating step in the furnace for a period of about 1 hour. The slab was rolled along the longitudinal axis to provide a plate being about 4.1 inches thick. The plate was annealed at 1350° F. for 4–5 hours, followed by air cooling. The plate was then shotblasted, pickled, sawcut and steam cleaned. A 4.1 inch thick plate was formed by this process.

Plates having thicknesses of about 2 inches and 1 inch have been produced in a manner similar to that described in Example 1. These plates were tested to determine the yield strength (YS; ksi) according to ASTM-E8, the tensile strength (TS; ksi) according to ASTM-E8, the percent elongation (El %) according to ASTM-E8, and the Charpy hardness (Charpy; ft.lb) according to ASTM E-23. The ballistic properties of the alloys also were evaluated.

The test results for plates produced according to example 1 are provided below in Table 2. "PLATE THICK" refers to the thickness of the plates tested; "DIREC" refers to the direction in which the plates were tested, either longitudinally or transversely; and "BALLISTIC" refers to the ballistic tests that were conducted. The entry "1.2" in the BALLISTIC column indicates that plates produced according to Example 1 performed 20 percent better than the standard alloy, Ti-6Al-4V.

TABLE 2

| PLATE THICK | DIR | YS | TS | El % | CHARPY | BALLISTIC |
|---|---|---|---|---|---|---|
| 4.0 in | L | 143.8 | 156.3 | 11 | 10.8 | 20% better than standard alloy |
| | T | 143.3 | 155.8 | 10 | | |
| 2.0 in | L | 144.3 | 156.7 | 8 | 11.5 | 20% better |
| | T | 143.8 | 154.1 | 15 | 14.0 | |
| 1.0 in | L | 147.2 | 157.5 | 13 | 12.3 | 20% better |
| | T | 152.4 | 162.6 | 15 | 11.0 | |

EXAMPLE 2

An armor plate was formed from an ingot having the elements discussed in section 1. The weight percent of each element was as follows: aluminum=6.28 weight percent; vanadium=3.94 weight percent; iron=0.245 weight percent; chromium=0.041 weight percent; nickel=0.079 weight percent; tin=0.15 weight percent; silicon=0.03 weight percent; cobalt=0.0066 weight percent; niobium=0.0041 weight percent; carbon=0.036 weight percent; oxygen=0.228 weight percent; and nitrogen=0.009 weight percent. A 30-inch ingot was heated to a temperature of 2100° F. for 12 hours and forged to form a slab 18 inches thick. This forged slab was heated for 30 minutes at a temperature of about 1900° F. This slab was then forged to be 13 inches thick, and the surface of the slab was subjected to a conditioning step.

A piece of the slab was heated at 1839° F. for 4 hours and 20 minutes. The slab was again forged to 5.25 inches thick. This slab was subjected to a conditioning step. The slab was heated to a temperature of about 1750° F. for a period of about 1 hour. Thereafter, the slab was rolled longitudinally to provide a plate having a thickness of about 1.05 inches. This plate was annealed at 1450° F. for 2–2.5 hours, followed by air cooling. The plate was then shotblasted, pickled, sawcut and steam cleaned. In addition to the 1.05 inch thick plate, an additional plate was made to be 0.655 inch thick.

Plates made according to the method described in Example 2 also were tested to determine the yield strength, the tensile strength, the percent elongation, the Charpy absorbed energy (ft.lb) and the ballistic properties. The test results for plates produced according to example 2 are provided below in Table 3.

TABLE 3

| PLATE THICK. | DIR | YS | TS | El | CHARPY | BALLISTIC |
|---|---|---|---|---|---|---|
| 0.655 in | L | 138.3 | 149.7 | 15 | N/A | WORSE THAN STANDARD ALLOY Ti-6Al-4V |
| 1.05 in | L | 140.0 | 152.3 | 14 | " | WORSE THAN |

TABLE 3-continued

| PLATE THICK. | DIR | YS | TS | El | CHARPY | BALLISTIC |
|---|---|---|---|---|---|---|
| | | | | | | STANDARD ALLOY Ti-6Al-4V |

Having illustrated and described the principles of the invention and its preferred embodiments, it should be apparent to those skilled in the art that the invention can be modified in arrangement and detail without departing from such principles. We claim all modifications coming within the spirit and scope of the following claims.

We claim:

1. A titanium-aluminum-vanadium alloy, comprising from about 5.75 to about 6.5 weight percent aluminum, from about 3.75 to about 4.25 weight percent vanadium, from about 0.2 to about 0.8 weight percent iron, from about 0.03 to about 0.1 weight percent chromium, from about 0.06 to about 0.1 weight percent nickel, from about 0.004 to about 0.01 weight percent cobalt, from about 0.006 to about 0.02 weight percent carbon, from about 0.24 to about 0.28 weight percent oxygen, from about 0 to about 0.03 weight percent nitrogen, the balance being titanium and unavoidable impurities totaling no more than about 0.5 weight percent, the alloy having an α-β microstructure.

2. An alloy according to claim 1 comprising from about 6.0 to about 6.4 weight percent aluminum.

3. The alloy according to claim 1 comprising from about 0.20 to about 0.50 weight percent iron.

4. The alloy according to claim 1 comprising from about 3.8 to about 4.0 weight percent vanadium.

5. The alloy according to claim 1 comprising from about 0.03 to about 0.1 weight percent chromium.

6. The alloy according to claim 1 comprising about 0.075 weight percent nickel.

7. The alloy according to claim 1 comprising about 0.0049 weight percent cobalt.

8. The alloy according to claim 1 comprising from about 0.027 to about 0.029 weigh percent carbon.

9. The alloy according to claim 1 comprising from about 0.265 to about 0.275 weight percent oxygen.

10. The alloy according to claim 1 comprising about 0.01 weight percent nitrogen.

11. A titanium-aluminum-vanadium alloy, useful for forming ballistic armor, comprising from about 6.0 to about 6.4 weight percent aluminum, from about 3.8 to about 4.0 weight percent vanadium, from about 0.20 to about 0.50 weight percent iron, from about 0.03 to about 0.1 weight percent chromium, about 0.075 weight percent nickel, about 0.0049 weight percent cobalt, about 0.0088 weight percent niobium, from about 0.027 to about 0.029 weight percent carbon, from about 0.265 to about 0.275 weight percent oxygen, about 0.01 weight percent nitrogen, the balance being titanium and unavoidable impurities totaling no more than about 0.5 weight percent, the alloy having an α-β microstructure.

* * * * *

UNITED STATES PATENT AND TRADEMARK OFFICE

CERTIFICATE OF CORRECTION

PATENT NO. : 6,053,993

DATED : April 25, 2000

INVENTOR(S) : Reichman et al.

It is certified that error appears in the above-identified patent and that said Letters Patent is hereby corrected as shown below:

| Col./Line | Error reads | Should read |
|---|---|---|
| Abstract | from is about | from about |
| 3/46 | 0.04 weight). | 0.04 weight percent). |
| 3/62 | (6th addition, 1977) | (6th edition, 1977) |
| 4/10 | residual are | residuals are |
| 6/58 | forging-the ingot | forging the ingot |
| 8/1 | ft.lb) | ft·lb) |
| 8/5 | "DIREC" | "DIR" |
| 8/56 | (ft.lb) | (ft·lb) |
| 10/11 | weigh | weight |

Signed and Sealed this

Twenty-second Day of May, 2001

*Attest:*

Nicholas P. Godici

NICHOLAS P. GODICI

*Attesting Officer*

*Acting Director of the United States Patent and Trademark Office*